US007582265B2

(12) United States Patent
Vera

(10) Patent No.: US 7,582,265 B2
(45) Date of Patent: Sep. 1, 2009

(54) GAS CONDUIT FOR PLASMA GASIFICATION REACTORS

(75) Inventor: Rodrigo B. Vera, Leeds, AL (US)

(73) Assignee: Plasma Waste Recycling, Inc., Huntsville, AL (US)

( * ) Notice: Subject to any disclaimer, the term of this patent is extended or adjusted under 35 U.S.C. 154(b) by 0 days.

(21) Appl. No.: 11/770,268

(22) Filed: Jun. 28, 2007

(65) Prior Publication Data

US 2009/0004071 A1 Jan. 1, 2009

(51) Int. Cl.
*F01N 3/08* (2006.01)
*B09B 3/00* (2006.01)

(52) U.S. Cl. ..... 422/176; 422/184.1

(58) Field of Classification Search ..... 422/176, 422/184.1; 251/24, 26
See application file for complete search history.

(56) References Cited

U.S. PATENT DOCUMENTS 3,778,024 A * 12/1973 Rogerson ..... 251/63
3,927,523 A * 12/1975 Shioyama et al. ..... 60/278
3,939,066 A * 2/1976 Bauer ..... 210/625
4,466,824 A * 8/1984 Gauvin et al. ..... 373/22
4,571,259 A * 2/1986 Fey et al. ..... 75/10.22
4,718,976 A * 1/1988 Fujimura ..... 216/67
4,802,507 A * 2/1989 Willson ..... 137/613
4,943,345 A * 7/1990 Asmussen et al. ..... 216/69
5,482,537 A * 1/1996 Eriksson ..... 95/273
5,723,027 A * 3/1998 Serole ..... 204/164
5,860,278 A * 1/1999 Rodenkirch ..... 60/313
5,863,619 A * 1/1999 Hur ..... 427/483
6,183,169 B1 * 2/2001 Zhu et al. ..... 406/123
6,546,812 B2 * 4/2003 Lewis ..... 73/861.63
6,752,957 B1 * 6/2004 De Lasa et al. ..... 422/22
6,848,681 B2 * 2/2005 Washington et al. ..... 261/76
2002/0018738 A1 * 2/2002 Woods et al. ..... 422/189
2002/0189369 A1 * 12/2002 Lewis ..... 73/861.63
2004/0045808 A1 * 3/2004 Fabry et al. ..... 204/173
2004/0084294 A1 * 5/2004 Hogan ..... 201/7
2004/0159366 A1 * 8/2004 Tsangaris et al. ..... 141/59
2004/0188868 A1 * 9/2004 Washington et al. ..... 261/116
2004/0231597 A1 * 11/2004 Dong et al. ..... 118/723 E
2005/0178748 A1 * 8/2005 Buchberger et al. .... 219/121.48
2007/0012231 A1 * 1/2007 Smith et al. ..... 110/233
2007/0289509 A1 * 12/2007 Vera ..... 110/250

* cited by examiner

*Primary Examiner*—Walter D Griffin
*Assistant Examiner*—Huy-Tram Nguyen
(74) *Attorney, Agent, or Firm*—George P. Kobler; Lanier Ford Shaver & Payne P.C.

(57) ABSTRACT

A gas conduit for venting high temperature reactor comprising a conduit portion in direct communication with the reactor for receiving gas therefrom where the conduit includes a Venturi for creating a high pressure zone in the area prior to exit of the reactor. The conduit, accordingly, has a portion having first and second diameters, where the second diameter less than the first diameter and is dimensioned in order to provide an area of high pressure in the region of the first diameter.

7 Claims, 2 Drawing Sheets

GAS CONDUIT FOR PLASMA GASIFICATION REACTORS

BACKGROUND

1. Field of the Invention

This invention relates generally to a high temperature reactors and, more particularly, to gas conduits for such reactors.

2. Description of the Problem

High temperature reactors, such as plasma reactors used for pyrolitic conversion of waste to constituent metals and organic matter, can create gaseous matter that may be used in many other processes. However, those skilled in the relevant arts will recognize that the reactor environment is highly ionized, and, the gaseous matter extracted from the reactor is ionized. A concern arises that due to the high energy levels found in ionized gases, unreformed gases may be removed from the reactor into the extraction conduit where the control of temperatures is not that accurate. A possible undesired result is, therefore, reformations of gases into undesired chemicals in the extraction conduit beyond the reactor.

SUMMARY

The present invention seeks to remedy this problem by providing a gas conduit for venting a high temperature reactor that is configured to create a localized high pressure area that enhances the environment for desired chemical reformations prior gases being completely extracted from the reactor. The conduit includes first and second diameters, where the second diameter is less than the first diameter and both diameters are dimensioned in order to provide an area of high pressure in the region of said first diameter.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1A:
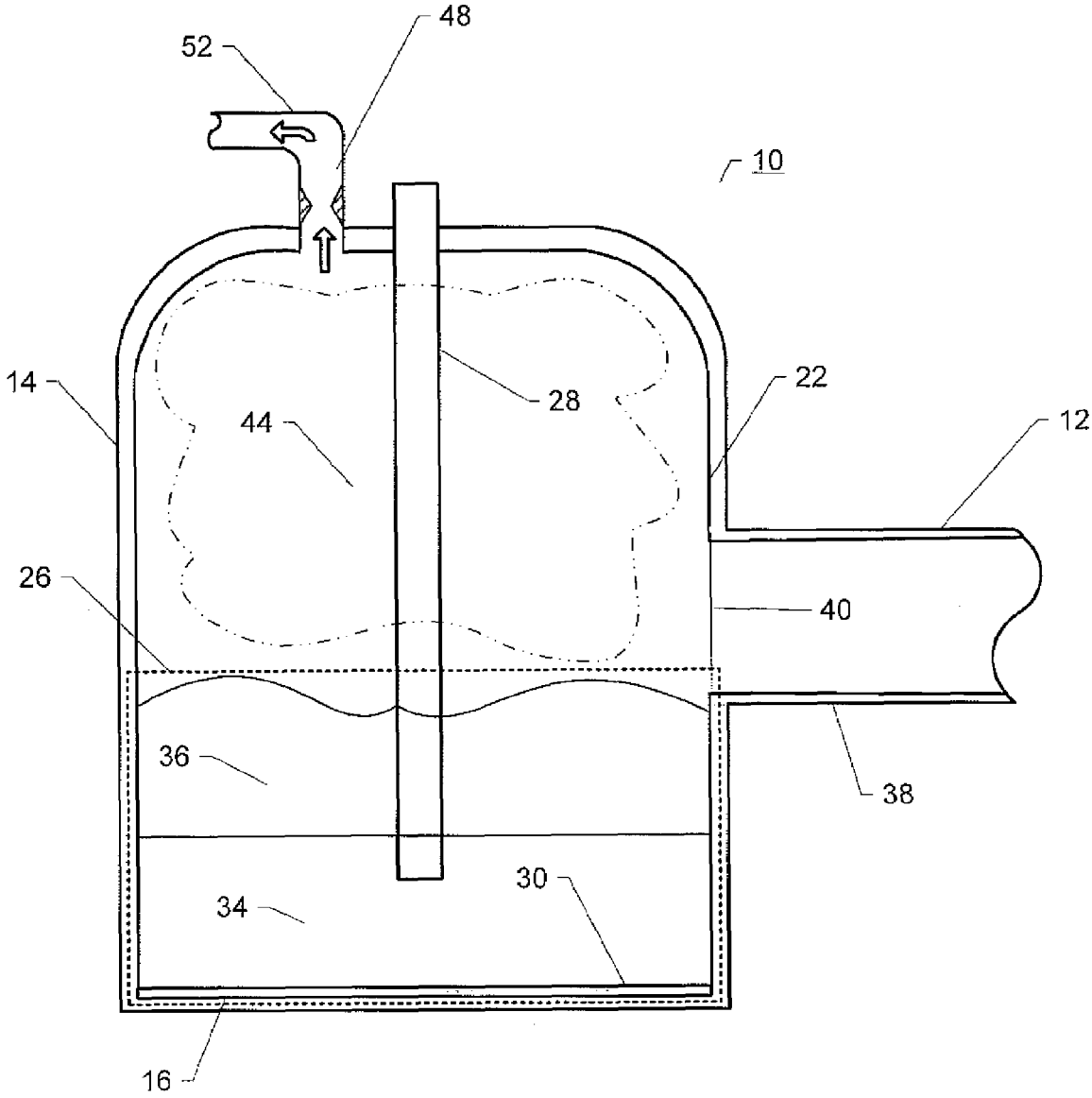
FIG. 1A is an exemplary plasma gasification system with a vent to a gas pipe adapted to include a Venturi throat.
Figure 1B:
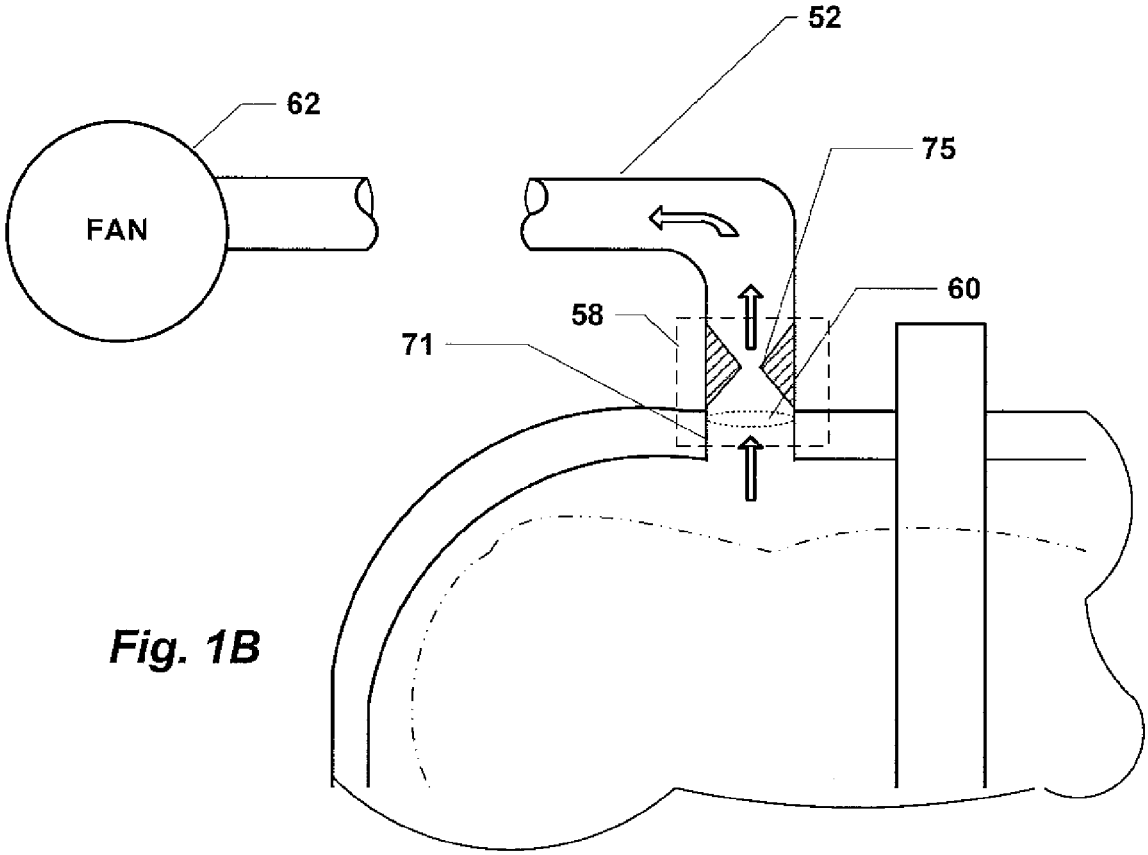
FIG. 1B is a more detail view of the gas pipe and Venturi throat of FIG. 1A.

The various embodiments of the present invention and their advantages are best understood by referring to FIGS. 1A and 1B of the drawings. The elements of the drawings are not necessarily to scale, emphasis instead being placed upon clearly illustrating the principles of the invention. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment. Moreover, features described with respect to a particular embodiment may also be employed in other disclosed embodiments as those skilled in the relevant arts will appreciate. This invention may be provided in other specific forms and embodiments without departing from the essential characteristics as described herein. The embodiments described below are to be considered in all aspects as illustrative only and not restrictive in any manner.

Referring now in detail to the drawings, there is illustrated in FIG. 1A, a pictorial diagram of an apparatus 10 for plasma gasification of hazardous and non-hazardous waste materials contained in organic and inorganic products. The apparatus 10 includes a waste feeder system 12, and a refractory-lined reactor vessel 14. The waste feeder system 12 is provided for feeding the hazardous and non-hazardous waste materials consisting of organic and inorganic components into the refractory lined reactor vessel 14 at a controlled rate. The waste feeder system feeds a stream of shredded and compact waste materials into the reactor vessel in a continuous manner. The hazardous and non-hazardous waste materials may include, but are not limited to, municipal solid waste (MSW), medical type waste, radioactive contaminated waste, agricultural waste, pharmaceutical waste, and the like.

The waste materials are delivered into the reactor vessel at a controlled rate so as to expose a predetermined amount of compacted waste to the thermal decomposition (pyrolysis) process for regulating the formation of product synthesis gases (syngas). The feed rate is dependent upon the characteristics of the waste materials as well as the temperature and oxygen conditions within the reactor vessel. Inside of the reactor vessel 14, a high temperature plasma arc generates temperatures in excess of 2,900 degrees F. so that, upon entry of the waste stream, it is immediately dissociated with the organic portion of the waste material being converted to carbon and hydrogen and the inorganic portion and metals of the waste material melted with the metal oxides being reduced to metal. A DC graphite electrode 28 and a conductive plate defining a cathode electrode 30 formed in the bottom of the reactor vessel are connected to a DC power supply (not shown) so as to create the high temperature plasma arc, as will be more fully described below. Alternatively, when two separate DC power supplies are used, each one is connected to one of the top electrodes and the bottom cathode electrode.

The bottom 16 of the reactor vessel 14 defines a hearth for receiving a molten metal bed or bath 26 which is heated by the DC graphite electrode 28 (anode) and a conductive plate defining a cathode electrode 30. The anode electrode 28 extends downwardly with its lower end being submerged in the molten bath 26. The cathode electrode 30 is mounted to and forms a portion of the bottom 16 of the reactor vessel, facing opposite to the anode electrodes. Alternatively, it should be understood by those skilled in the art that a single cathode electrode may be formed in the center of the bottom 16 of the reactor vessel or multiple cathodes may be spaced uniformly throughout the bottom 16 of the reactor vessel in lieu of using the conductive plate as illustrated.

During operation, the molten bath 26 filling the bottom 16 of the reactor vessel 14 will be separated into a bottom metal (iron) layer 34 and an inorganic "foamy" or "gassy" slag layer 36. It will be noted that the lower end of the anode electrode 28 is preferably submerged into the slag layer 36. The waste materials are fed into the vessel 14 via a feeder extrusion tube 38 and opening 40. By injecting the waste materials directly into the slag layer 36 of the molten bath 26, the waste materials are immediately subjected to very high temperatures, i.e., above 2900 degrees F., that completely disassociates the waste materials.

The organic portion of the waste material will disassociate into the synthetic gas (or "syngas") 44 consisting of a carbon and hydrogen mixture. The inorganic portion of the waste material will be melted with the metal oxides and will be reduced to a metal, which is accumulated at the bottom of the molten bath. All of the inorganic compounds will form the vitreous slag layer 36 disposed above the metal layer 34.

A gas vent or duct 48 is also provided in the upper end of the reactor vessel 14, which is designed to convey the produced syngas 44 at a temperature of about 875 to 1,000 degrees C. via a gas pipe 52 for further processing. The gas pipe 52 has a diameter to control the gas exiting velocity in order to minimize particulate entrapment and to maximize the efficiency of the plasma gasification.

The process of the present invention for converting the mixture of organic and inorganic portions of the waste materials into the vitreous slag and the syngas will now be explained. Initially, it should be understood that the present process has particular applications for the destruction of a wide variety of waste materials as well as for use in such industrial processes as coal gasification or the gasification of other waste materials. As the waste materials are delivered into the processing chamber 22 of the reactor vessel 14 by the feeder system 12, the waste materials will absorb energy by convection, conduction, and radiation from the long plasma arc discharges generated, the hot vitreous slag, the heated refractory lining, and the heated gases circulating within the processing chamber 22. As the organic portion of the waste materials is heated, it becomes increasingly unstable until it eventually disassociates into its elemental components consisting mainly of carbon and hydrogen.

The syngas 44 expands rapidly and flows from the processing chamber 22 to the gas pipe 52 via the gas vent or outlet 48, carrying with it a portion of any fine carbon particulate generated by the disassociation of the waste. The process is designed to deliver the syngas 44 at a temperature of about 875 to 1,100 degrees C. for further processing. The gas pipe 52 is designed to be airtight so as to prevent the syngas 44 from escaping or allowing atmospheric air to enter. The gas pipe 52 is also preferably refractory lined in order to maintain the effective temperature of the syngas 44 above 875 degrees C. to substantially prevent the formation of complex organic components and to recover as much of the latent gas enthalpy as possible. Gas pipe 52 includes exhaust fan 62 for creating a low pressure area downstream from the vent 48 to assist in drawing syngas 44 from the reaction chamber 22.

Those skilled in the relevant arts will recognize that the reactor interior environment is ionized. Ionized gas molecules may be drawn out of the reactor and into the exhaust vent 48 of the plasma vessel. A concern arises that due to the high energy levels found in ionized gases, full reforming reactions desired may not have completed before entry into the gas pipe 52. As such, unreformed gases will move into the gas pipe 52 where the control of temperatures is not that accurate. A possible undesired result is, therefore, reformations of gases into undesired chemicals.

To ameliorate this, the gas pipe 52 is adapted to include a Venturi 58. This Venturi 58 will cause an area of high pressure 60 relative to the remainder of the conduit to be generated prior exacted upon the gas as it is drawn through the throat. The high pressure area 60 will accelerate reaction time and thus improve the chances that all reformation will occur in the reactor and not in the ductwork. Any head losses caused by the Venturi 58 should be small enough that they can be compensated by the exhaust fan 62. Like the reaction chamber, the surface of the Venturi 58 should be refractory lined. A Venturi 58 comprises at least a first, or starting diameter 71 which is the portion of the conduit in direct communication with the reactor, and a second, narrower diameter 75. It is known in the art that in the region of the second diameter an area of lower pressure exists.

The internal diameter of the Venturi 58 will depend upon the density of the syngas and its velocity. The density of the syngas depends upon the material processed in the reactor. The velocity depends in part upon the conduit internal diameter and the exhaust fan. Issues such as gas viscosity, Bernoulli's Principle, Reynold's Number and friction losses caused by the walls of the Venturi are also significant, as would be appreciated by those skilled in the relevant arts. It is possible to operate this and other systems using additional oxygen and have complete oxidation of the gases. As the purpose of the use of a Venturi is to increase the efficiency of the system, care must be taken to size the Venturi with an awareness of the efficiencies of the draft generating mechanism in the system. With this in mind, a Venturi suitable for application in this invention should have starting diameter and a narrow diameter dimensioned to provide up to about a 3 psi pressure differential between the high pressure area to the low pressure area.

As described above and shown in the associated drawings, the present invention comprises a gas conduit for plasma gasification reactors. While particular embodiments of the invention have been described, it will be understood, however, that the invention is not limited thereto, since modifications may be made by those skilled in the art, particularly in light of the foregoing teachings. It is, therefore, contemplated that any claims issuing in an ensuing patent will cover any and all such modifications that incorporate those features or those improvements that embody the spirit and scope of the present invention.

I claim:

1. A plasma gasification reactor comprising:

a refractory lined reactor vessel defining a chamber into which is fed organic and inorganic material through an opening within a wall of said chamber at a height substantially co-level with the surface of a slag layer contained within the lower volume of said chamber;

an electrode extending into said chamber and a conductor located on a bottom surface of said chamber operable for generating a plasma arc;

an outlet within an upper portion of said chamber; and a conduit-coupled directly to said outlet, said conduit having a first diameter immediately adjacent said reactor chamber, and a second diameter on a downstream side of said first diameter and immediately adjacent thereto, said second diameter less than said first diameter and dimensioned in order to provide an area of high pressure in the region of said outlet.

2. The plasma gasification reactor of claim 1, wherein said conduit further comprises a refractory material.

3. The plasma gasification reactor of claim 1, wherein an end of said electrode extends below the level of the surface of the slag layer.

4. The plasma gasification reactor of claim 3, wherein said conduit further comprises a refractory material.

5. A plasma gasification reaction chamber within which is an electrode electrically coupled to a conductor in a floor of said chamber operable for generating a high-temperature plasma, said chamber further comprising:

an opening through which organic and inorganic material is fed for reaction with the high-temperature plasma within said chamber, said reaction resulting in a slag layer comprised within a lower volume of said chamber, and a gas within the upper volume of said chamber;

an outlet within an upper portion of said chamber through which said gas exits said chamber; and a conduit-coupled directly to said outlet for receiving gas therefrom, said conduit having a first diameter immediately adjacent said reactor chamber, and a second diameter on a downstream side of said first diameter and immediately adjacent thereto, said second diameter less than said first diameter and dimensioned in order to subject said gas to high pressure in the region of said outlet.

6. The plasma gasification reaction chamber of claim 5, wherein an end of said electrode extends below the level of the surface of the slag layer.

7. The plasma gasification reactor of claim 6, wherein said conduit further comprises a refractory material.

* * * * *